United States Patent [19]

Peterson

[11] 4,303,000

[45] Dec. 1, 1981

[54] SWELL BOX FOR HYBRID PIPE ORGAN

[76] Inventor: Richard H. Peterson, 11748 Walnut Ridge Dr., Palos Park, Ill. 60464

[21] Appl. No.: 175,546

[22] Filed: Aug. 5, 1980

[51] Int. Cl.[3] ..... G41O 3/16

[52] U.S. Cl. ..... 84/346

[58] Field of Search ..... 84/346, DIG. 17; 181/175, 200

[56] References Cited

U.S. PATENT DOCUMENTS

| | | | |
|---|---|---|---|
| 500,040 | 6/1893 | Skinner | 84/346 |
| 1,225,666 | 5/1917 | Lockwood | 84/346 |
| 1,230,165 | 6/1917 | Hope-Jones | 84/346 |
| 1,835,360 | 4/1929 | Walters | 84/346 |
| 2,005,643 | 6/1935 | Willis et al. | 84/346 |
| 2,072,844 | 3/1937 | Austin | 84/346 |
| 2,191,734 | 3/1939 | Wick | 84/346 |
| 2,910,907 | 9/1955 | Bowman | 84/346 |

*Primary Examiner*—Donald A. Griffin
*Assistant Examiner*—Benjamin R. Fuller
*Attorney, Agent, or Firm*—Jones, Tullar & Cooper

[57] ABSTRACT

A compact hybrid pipe organ, wherein certain bass notes are electronically produced, and wherein the remaining notes utilize a compact and portable swell box to produce the characteristics pipe organ tones, is disclosed. The swell box is just large enough to encompass a selected number of ranks of organ pipes, the pipes being oriented to have their opening facing toward an open side of the swell box so that the tones are directed outwardly away from the back surface of the box. The open front of the box is selectively closable by means of a plurality of pivotally mounted shutters which rotate under the control of the organist. At least the rear wall of the swell box is covered with a sound-absorbent material to prevent rearwardly-directed sound waves from being reflected in a forward direction, and thus, to prevent the production of standing waves within the swell box. The shutters may be of a non-sound-absorbent material, and thus may be of wood, or in a preferred form, may be glass plates. The shutters need not overlap, since a tight seal of the box is not required, but may pivot into an edge-to-edge alignment across the front of the box in the closed condition, leaving sufficient space between the adjacent shutters for ease of operation, without adversely affecting the musical performance of the swell box.

8 Claims, 4 Drawing Figures

FIG. 1
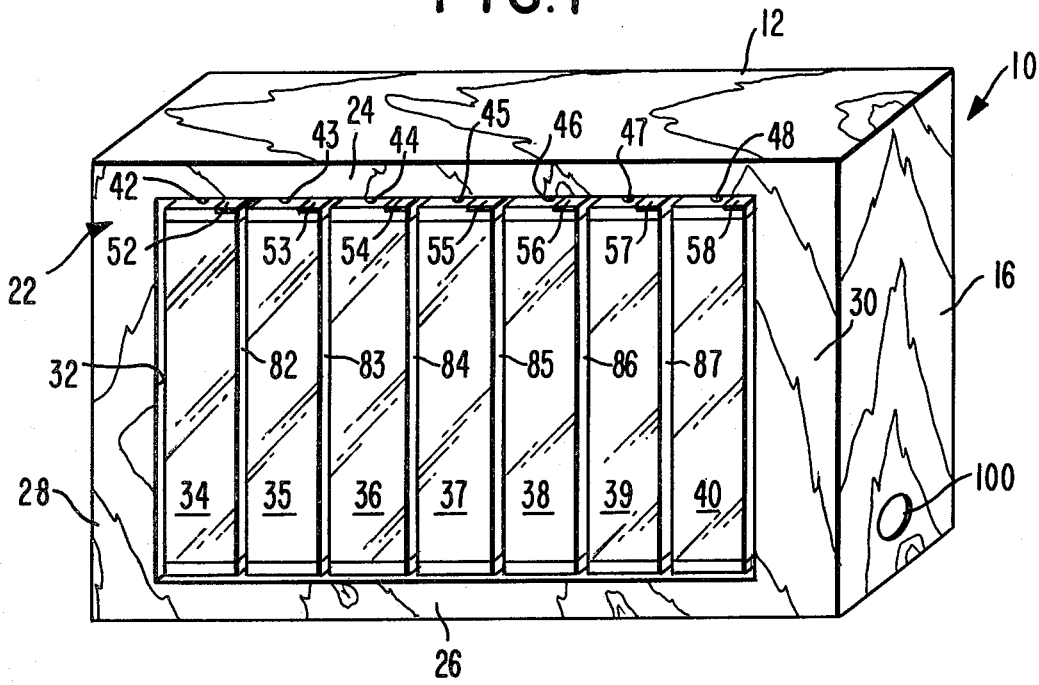
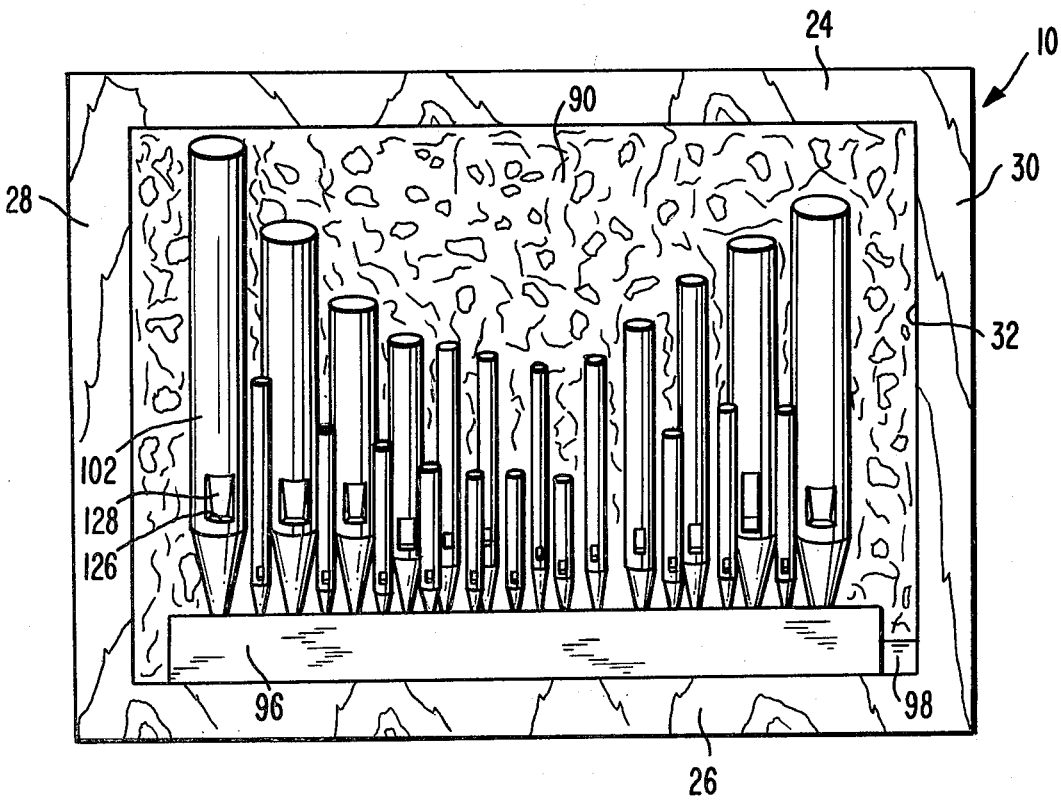
FIG. 4

FIG. 2
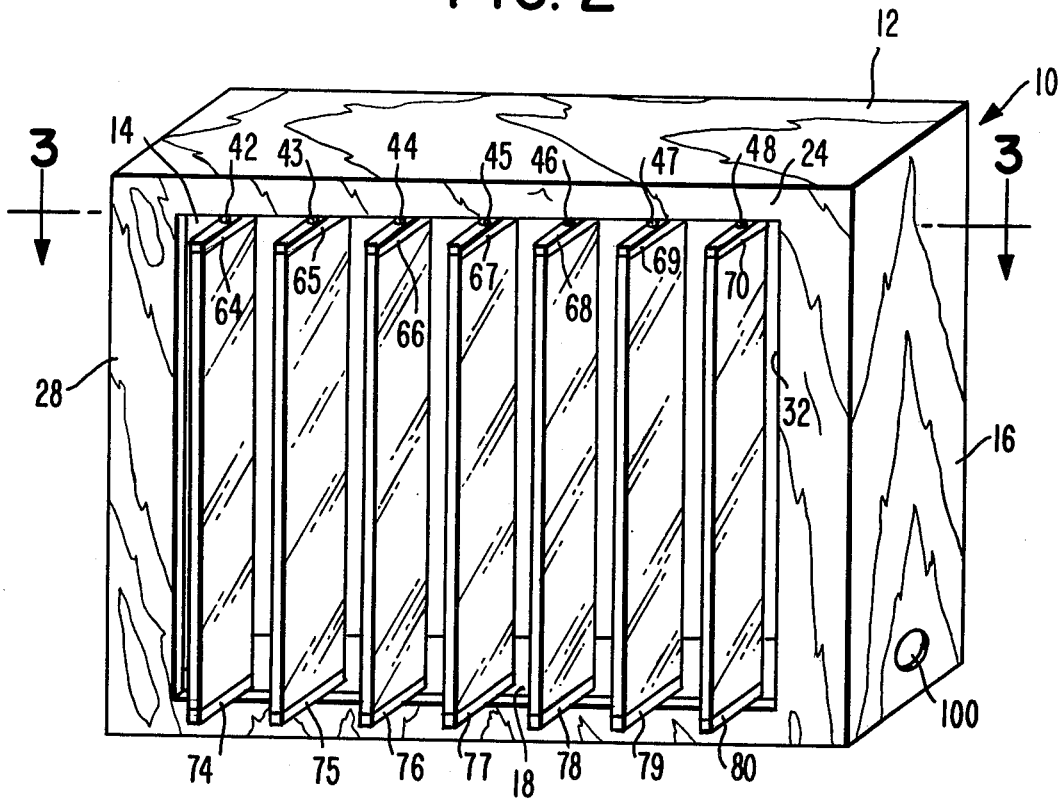
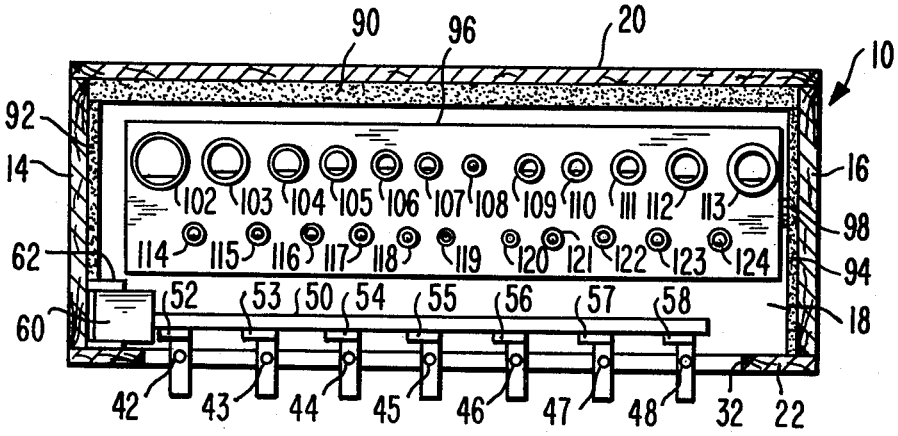
FIG. 3

SWELL BOX FOR HYBRID PIPE ORGAN

BACKGROUND OF THE INVENTION

The present invention relates, in general, to the art of pipe organs, and more particularly to a compact pipe organ wherein the size and expense of conventional organs is greatly reduced without sacrificing the unique quality of sound produced by such organs.

As is well known, a pipe organ produces unique and characteristic sound qualities which make it one of the most desirable musical instruments. These sound qualities are due in part to the complexity of the musical tones produced by each organ pipe, for each pipe has a particular structure which gives it its own characteristic harmonic structure, its own speech characteristic, its own way of starting and stopping, and its own response to pressure changes caused, for example, by tremulant devices. Thus, when a note is produced by an organ pipe, the pipe, in starting, goes through different tonal modes until it reaches a steady state condition. Similarly, when the playing key is released, the sound fades away and during the decay period its harmonic structure again changes. Additionally, during the decay period there is a shifting of the phases of the different partials with respect to one another. These dynamic factors within the organ pipe itself, taken with the fact that a large number of pipes are provided, each of which sounds its tone from a different point in space, result in the highly complex sound pattern which is characteristic of an organ, and which is virtually impossible to duplicate electronically. Even if some of the sounds might be successfully simulated, the electronic means for doing so would involve such high costs that the resultant instrument would probably be more expensive than the pipe organ itself, for such simulation would require an amplifier channel and a loudspeaker for each note in each rank of the organ in order to reproduce the directional effect of the sound from an organ, and would require sophisticated electronics to reproduce as nearly as possible the unique qualities of the pipe itself in shifting from one tone to another as it picks up and fades away.

In spite of the extraordinary and desirable sound produced by pipe organs, they do have certain drawbacks which have limited their usefulness in some applications. One such drawback arises from the fact that with many organs it is extremely difficult to obtain a suitable degree of "expression", or control of the volume of sound produced. On very large organ installations, expression can be obtained in certain degree through the provision of a large number of ranks of pipes with a wide variety of stops which allow the organist to select various registers not only for the quality of sound, but for volume control. Particularly in smaller installations, however, where the number of ranks is limited because of factors such as cost, insufficient space, or the like, but also in some large installations, it has been the practice to provide the desired expression by locating all, or at least some, of the pipe ranks within an enclosed space referred to as a "swell chamber". The swell chamber is, generally speaking, a large, room-sized enclosure that is relatively soundproof on all sides except the one which communicates with the room into which the sound is to be directed, i.e., the listening room. This open side of the swell chamber is closable by means of shutters (usually vertical) which are pivotally mounted so that they can be opened and closed by the organist to vary the volume of the sound projected into the listening space (see, for example, U.S. Pat. No. 500,040 to Skinner and U.S. Pat. No. 2,005,643 to Willis et al.). However, much more than the volume of sound is affected by these shutters; a swell chamber of the foregoing type also has profound effects on the tone quality, so that the changes which the moving shutters produce may be more properly referred to as "swell effects". For example, the opening of the shutters changes the reverberant characteristics of the swell chamber, since these characteristics are different for the chamber by itself than for the chamber attached to the room to which the sound is directed. Furthermore, a dynamic change in these characteristics occurs as the shutters move, the motion of the shutters changing the paths that the sound waves take between the source of the tone and the listeners. Since the organ pipes generally are spread throughout a swell chamber, the path lengths from each pipe to each of the shutter openings are different. These path lengths change as the shutter positions change so that the distance from any given pipe to listener's ear constantly changes as the shutters move, producing Doppler effects and other variations in the sound being heard. The tone quality of the sound produced by a swell chamber also varies because of the greater attenuation of high frequencies than low frequencies when the shutters are closed; similarly, the overall structure of the walls of the swell box, which vibrate more or less in accordance with the frequencies produced by the pipes and the rigidity of the walls, also affects the quality of tone. Thus, the use of a swell chamber and shutters with a pipe organ produces many subtle, highly desirable, dynamic variations in the tone, color and volume of the sound produced by an organ.

However, a serious problem exists with most organ installations in that a properly constructed swell chamber for a large pipe organ is extremely expensive to install, in addition to the fact that it requires a large amount of space within the building which might be used for other purposes. The larger the installation, the more the cost increases, since the requirements for air to operate the pipes move up with the cube of the pipe size. Thus, as the pipes get bigger, larger air blowers become necessary and the larger the blower, the more remote must be its location so that it will not intrude on the sound produced by the pipes. A remote location, however, requires, large and expensive air ducts to be installed. Similarly, the greater the flow of air, the larger are the requirements for air regulators and for tremulant devices, with the end result being an extremely high cost which makes such installations impractical in many cases.

Another difficulty encountered with the use of swell chambers lies in the fact that such chambers are usually substantially closed off from the listening room, particularly when the organ is not in use. As a result, the temperature in a swell chamber can vary over a wide range, and such temperature variations can detune the pipes.

It has also been found that it is very difficult to obtain suitable variations in the sound volume produced by the pipes through adjustment of the shutter positions in typical swell chamber installations, since in general the size of the shutter opening is relatively small with respect to the volume of the chamber. Attempts to improve the expression from such chambers led to various shutter constructions that attempted to obtain the desired range of sound volume by reducing the amount of sound escaping from the chamber when the shutters are closed. A variety of shutter seal designs were developed for this purpose (see, for example, U.S. Pat. Nos. 1,230,165 to Hope-Jones, 1,225,666 to Lockwood, and 2,072,844 to Austin), but this approach was found to be unsatisfactory since attempts to seal the shutters upon closure led to problems of shutter slamming, binding of the shutter mechanism with changes in temperature or humidity, and the like.

In the past, some attempts have been made to simulate organ sounds by placing a small group of organ pipes in a piano housing (see, for example, U.S. Pat. No. 1,835,360 to Waters), in an old-style player piano device such as a nickelodeon, wherein both the piano and the small group of pipes were played from a piano roll, or in a small, portable housing (see U.S. Pat. No. 2,910,907 to Bowman). Occasionally these housings were provided with shutters to control the volume of sound as in the Waters patent, and in general they were constructed with flat, reflective internal surfaces designed to project the sound outwardly. However, these arrangements did not provide true swell chamber simulation, and none were successful in producing a quality musical sound since the placement of such groups of pipes in small housings or boxes of this type resulted in a serious detuning effect on the organ pipes and provided an undesirable coloration of the sounds. Further, they produced an overly "bottled up" sound not entirely attributable to the reduced volume when the housing shutters were closed, and presented problems of air pressure buildup when the shutters were closed.

The detuning and coloration effects produced by such prior devices were not particularly objectionable in the early instruments, since they were almost always used for popular music which would have some form of a vibrato or tremulant. This caused the tones to shift so much that the average pitch was not readily ascertainable to the listener; thus, it did not matter if the pipes were out of tune. However, such detuning is very objectionable in an organ played without tremulant or where the nature of the music is such that even small amounts of detuning would be noticed by the listener, as in a church organ or a concert organ. It was found that the problem of detuning which occurred in the prior devices varied with different pipes and with different positions of the shutters so that a given pipe might be in tune with an opened shutter, be drastically detuned at a half closed shutter, and come back, into perfect tune when the shutter was fully closed, while another pipe might undergo just the opposite effect. The prior art was not able to solve this problem of detuning, and thus the early attempts at providing small enclosures for organ pipes in order to simultate the large organ sound never progressed beyond the state of being a mere novelty.

One prior art attempt to overcome what was perceived as a problem with pipe organs in the lower frequency range resulted in placement of the organ pipes in a soundproof enclosure, and locating a microphone in the enclosure to electronically reproduce the sound. U.S. Pat. No. 2,191,734 to Wick utilized such a system to overcome "peaks and hollows" in the sound produced by various pipes so that a nearly even relative strength and quality is provided. However, such an enclosure is not a swell chamber, and does not produce the desirable effects of a swell chamber, and thus did not represent a solution to the problems presented by large and expensive swell chamber installations.

It has now been found that by proper construction in accordance with the present invention, a compact swell box can be provided which does not have the detuning effect of prior devices and which, therefore, produces the desirable tone characteristics of a swell chamber in a structure that is reduced in size and expense without a corresponding reduction in quality of sound.

SUMMARY OF THE INVENTION

It is, therefore, an object of the present invention to provide a compact, practical pipe organ which retains the desirable characteristics of large pipe organs, yet eliminates undesirable space requirements and resultant high costs.

It is another object of the present invention to provide a compact swell box for a pipe organ.

It is a further object of the present invention to provide a small, compact swell box for use with organs wherein the notes are generated through conventional pipes contained in a swell box to retain the desirable characteristics of a swell chamber organ.

Another object of the invention is the provision of a compact swell box containing one or more ranks of pipes, wherein the box is relatively portable, mountable on a wall or in an existing space and which retains the desirable characteristics of a swell chamber while reducing the installation cost.

A further object of the invention is the provision of a swell box that is compact and relatively portable, yet is capable of producing a wider range of expression than heretofore thought possible, without the need to seal the shutter edges, and without the problem of pressure buildup within the box.

Another object of the invention is to provide a compact swell box having shutters constructed of glass plates which enhance the appearance of the device, while producing no adverse effects in the quality of the sound.

Another object of the invention is the provision of a compact pipe organ utilizing a small, relatively portable swell box which substantially reduces the size and cost of a swell chamber while retaining the psychological and musical effects on the listener of a full-sized swell chamber.

In accordance with the foregoing, the present invention is directed to a compact swell box construction that retains the musical characteristics of a conventional swell chamber while eliminating the high cost of installation. In attempting to construct such a compact swell box, it was found that the geometry of small enclosures for organ pipes creates standing waves, which cause node points or anti-node points to appear either at the mouth or at the top of a pipe to influence its effective geometry and to cause the pipe to detune. Movement of any closure device for controlling the volume of sound produced by such an enclosure would change the standing wave pattern within the housing and would move the various node and anti-node points in such a way as to affect one or more other pipes. Whenever, a node point appeared at precisely the wrong place a pipe would be detuned, and almost any pipe would show some detuning at some position of the shutters in a way that was totally random and unpredictable. Because of this, numerous attempts at constructing an effective very small swell box were unsuccessful.

Although all prior teachings concerning swell chambers have emphasized that such chambers must utilize highly reflective surfaces in order to effectively project the sound and keep it from being trapped within the chamber, it was found that the detuning effect in small swell boxes could be eliminated by providing a structure directly contrary to such prior teachings. Thus, in accordance with the present invention, a sound-absorbent material is placed on the rear wall of the swell box, and on the side, top and bottom walls as well, as needed, to eliminate acoustical standing waves which occur within the box, principally between the front and rear walls thereof. This sound-absorbent material prevents sound waves from being reflected off the back of the swell box by absorbing back radiation from the pipes directly, and absorbing sound that is reflected from the shutters indirectly.

At the same time, the swell box is constructed with a very shallow depth so that the pipes are relatively close to the front of the box, whereby a substantial portion of the sound is radiated directly outwardly so that the swell box need not rely on reflected back radiation for obtaining the desired sound. Further, because of the shallowness of the box even the rear ranks of organ pipes are relatively unimpeded, particularly if the pipes are properly oriented within the box so that the mouth of each pipe faces forwardly in a direction that produces the least amount of impedance from pipes placed in front of it. In the preferred form of the invention, the absorbent material provides a large number of surfaces of different sizes and having different angles so as to break up the reflection of sound to the greatest possible degree. The reflection of the sound from a variety of angles and surfaces produces random wave patterns which serve to eliminate the problem of standing waves.

BRIEF DESCRIPTION OF THE DRAWINGS

The foregoing and additional objects, features and advantages of the present invention will become evident to those of skill in the art through a consideration of the following detailed description thereof, taken in conjunction with the following drawings, in which:

FIG. 1 is a perspective view of a swell box constructed in accordance with the present invention, and showing its swell control shutters in the closed position;

FIG. 2 is a perspective view of the swell box of FIG. 1, showing the swell shutters open;

FIG. 3 is a top sectional view of the swell box of the invention, taken along lines 3—3 of FIG. 2; and FIG. 4 is a front view of the swell box of FIG. 1, with the swell shutters removed.

DESCRIPTION OF A PREFERRED EMBODIMENT

Turning now to a more detailed consideration of the invention, there is illustrated in FIG. 1 a swell box 10 constructed in accordance with the present invention. The swell box consists of a housing having a top wall 12, side walls 14 and 16, (see FIG. 3), a bottom wall 18 and a rear wall 20. These walls form a rectangular housing having a front opening which may be partially covered by a front wall 22 which, in turn, consists of top and bottom rails 24 and 26 and side rails 28 and 30 which cooperate to define a shutter opening 32.

Mounted within the shutter opening 32 and pivotal about their vertical axes are a plurality of swell control shutters 34–40. Although the shutters may be constructed of wood, as are the various walls of the housing, and although wood will work satisfactorily, a preferred material for the shutters is plate glass, for glass not only provides the desired swell effects from the swell box when the shutters are pivoted about their respective axes, but in addition provides a relatively umimpeded view of the organ pipes within the swell box. It will be understood that any suitably rigid material may be used for the shutters, however.

The swell control shutters are mounted within the shutter opening by means of a suitable pivot pins such as the top pins 42–48 illustrated in FIG. 3 and corresponding bottom pins (not shown) journalled in or otherwise secured to the top and bottom rails 24 and 26, respectively. In the illustrated embodiment, the pivot pins are mounted at the centers of their corresponding shutters so that when the shutters pivot to their open position, illustrated in FIG. 2, one-half of the shutter extends outwardly of the swell box housing and one-half extends inwardly. It will be apparent, however, that the shutters may equally well be pivoted at one edge and mounted to swing either inwardly or outwardly, as desired.

The shutters are movable between the open and closed positions shown in FIGS. 1 and 2 by means of a suitable mechanism such as the transverse arm 50 illustrated in FIG. 3. This arm is connected by suitable linkage (not shown) to corresponding lever arms 52–58 mounted on the shutters, whereby longitudinal motion of the traverse arm causes the shutters to pivot between the two illustrated positions. The traverse arm may be operated by any suitable swell shade operator 60 or "swell engine". Such devices are conventional in the art, and need not be described here. The swell shade operator 60 may be secured to a stationary platform such as the side wall 14 as by a bracket 62. Although the illustrated traverse arm operates satisfactorily to move all of the shutters simultaneously, some organ builders find it desirable in some circumstances to provide an individual drive mechanism for each shutter or for various combinations of shutters, so that they may be operated sequentially either individually or in selected sets.

Where the shutters are constructed of wood or a like material, the pivot pins 42–48 and the linkage arms 52–58 can be secured directly to the shutters; however, where glass shutters are provided, it may be desirable to mount the glass plates in upper and lower frames 64–70 and 74–80, respectively, which frames in turn carry the pivot pins and the linkage arms.

As illustrated in FIGS. 1, 2 and 3, the shutters preferably are mounted so that they open to a position substantially perpendicular to the front opening, or front face, or the swell box in order to provide the maximum opening for the sound produced by the organ pipes contained within the swell box, and to thereby produce maximum volume. In order to avoid a buildup of air pressure within the swell box, and consequent detuning effects, when the shutters are closed, it has been found desirable to leave a small amount of space between adjacent shutters in the manner broadly illustrated in FIG. 1. This arrangement distinguishes from conventional room size swell chambers where the shutters are overlapped so as to maximize the sealing effect when the shutters are closed and to permit a maximum volume deviation between the open and closed positions. With the present invention, however, an improved expression, or deviation, is obtainable even without such a sealing effect, due to the fact that when the shutters are closed, a sound absorbing material (to be described) attenuates sound waves reflected from the rear surfaces of the shutters. This attenuation of sound within the closed swell box permits a greater range of control for the sound volume between the open and closed positions of the shutters than was possible in previous swell chambers, thus enabling the use of glass plates in the edge-to-edge arrangement illustrated in FIG. 1 without the loss of the desired "expression" effect. The edge-to-edge spacing between the adjacent shutters, indicated in FIG. 1 at 82–87, eliminates the need for close-tolerance cutting and grinding of the glass plates, thus reducing the cost of making the shutters, and also insures a free and smooth operation of the shutter arrangement. Although it is desirable that the shutter opening 32 is substantially closed when the shutters are in their closed positions, the spacing is not critical.

As illustrated in FIGS. 3 and 4, sound absorbing means such as a conventional sound insulating panel of perforated Cellotex, or the like, a batt of glass fibers, heavy carpeting, fabric, or a suitable panel containing a plurality of sound absorbent fissures or angled surfaces is provided within the housing. In FIG. 3, absorbent panels 90, 92 and 94 are illustrated as being mounted on or as forming a part of the rear wall 20 and the left and right side walls 14 and 16, respectively. Although this sound absorbent material may also be included on the top and bottom walls 12 and 18 of the housing as well, it has been found that satisfactory results can be obtained in many cases by using only the rear wall sound absorbent panel 90, and thus in a preferred embodiment, only the rear panel provides a sound absorbing surface. As best seen in FIG. 4, the sound insulating material preferably is of a type which presents a large number of randomly oriented surfaces to any impinging sound waves so that the waves are, in effect, broken up and dispersed, some of the sound being absorbed in the material and some being reflected in random directions to insure that no standing waves are formed within the swell box 10. In a preferred form, the panel 90 consists of a standard acoustical tile material which absorbs a large proportion of the sound waves which impinge upon it, and which includes fissures and small openings which produce a broken surface that effectively causes any waves that are reflected to be deflected in a random way to prevent the buildup of standing waves. Other sound absorbing materials such as heavy carpeting or folded drapery material may be used to also produce decorative effects, if desired.

Mounted within the swell box 10 is an air chest 96 which is connectable through an air conduit 98 and an opening 100 in the side wall 16 of the swell box to a suitable source of pressurized air. Mounted on the air box, and in communication with the interior thereof in conventional manner, is a plurality of organ pipes such as those diagrammatically illustrated at 102–124, arranged in two ranks, for example, pipes 102–113 comprising a first, or rearmost rank, and pipes 114–124 comprising a forward rank. These pipes are preferably arranged in an aesthetic array, with the two ranks being in a staggered arrangement, as illustrated, so as to provide an unimpeded flow of sound from each pipe to the shutter opening of the swell box. With the labial type of organ pipe, which is shown in the figures for the purposes of illustration, air flows upwardly from the air chest through an air gap, or opening, indicated at 126 on pipe 102, the air flowing past a sharp-edged lip 128 in known manner to produce a vortex motion of the air and to produce sound through the generation of resonant vibrations in the air column within the pipe. The length of the pipe is a multiple of one-half the wavelength of the frequency of sound produced by the pipe, with the top of the pipe being either opened or closed. In the case of a closed, or stopped, pipe, the sound produced is one octave lower than that produced by the pipe when it is open.

The sound emitted by each of the organ pipes is essentially radiated forward from the opening, or gap, 126, although some sound is radiated in other directions. Thus, it is important in the operation of the present system that the pipes be so oriented that the gaps are all directed in such a way that the sound is emitted toward the shutter opening and has a substantially unimpeded access to the exterior of the swell box when the shutters are open. When the shutters are partially or completely closed, a portion of this sound reflected back toward the pipes and thus toward the rear wall of the swell box, the proportion of sound reflected to sound emitted through the shutters depending upon the shutter position. The sound panel 90, together with any side, top or bottom panels of insulating material provided, absorbs substantially all of the sound which impinges upon it so that even with the front shutters fully closed there will be substantially no generation of standing waves within the swell box. Accordingly, there will be no change in a standing wave pattern when the shutters move toward their open or closed positions, and consequently there will be no detuning of the organ pipes.

Although two ranks of pipes have been illustrated in FIGS. 3 and 4, it will be understood that the swell box may incorporate just a single rank of pipes, or in the alternative, may incorporate several ranks, depending upon the needs of the particular organ. It will further be understood that each organ pipe includes a suitable valve for controlling the admission of air to the pipe from the air chest 96, with these valves being controllable by an organist at a conventional organ console. These valves are preferably electrically operated under the control of the organ keyboard. If desired, two or more swell boxes may be controlled from a single organ console, with each swell box carrying different ranks of pipes and being connected to corresponding console keys. Similarly, the shutters on the swell boxes would be under the control of corresponding swell pedals on the organ console with, for example, one being connected to the accompaniment swell pedal and another being connected to a solo swell pedal to provide the desired range of sound effects.

The size of a particular swell box will depend upon the particular organ with which it is to be used, and thus upon the size and number of pipes which are to be incorporated in it. If open pipes are used, a larger box will be required than if stopped pipes are used, and the dimensions will depend essentially on the lowest notes which are to be produced within the swell box. However, in order to obtain the desired expression and tonal characteristics previously attainable only in large room-sized swell chambers, it has been found that the swell chamber must be substantially shallower than the height and width dimensions, and that the area of the opening provided by the shutters should present an "aspect ratio" of approximately 1 to 3 in comparison to the total area of the remaining interior surface of the swell box. Thus, for example, if the openable surface area of the front of the box is about 20 ft.$^2$, the total closed surface of the back, sides and top of the swell box would be about 60 ft.$^2$.

In one embodiment of the invention, a swell box utilizing two ranks of pipes was constructed, with the lowest pipe tone being produced by a two-foot long pipe. This required a box having a height of approximately 44 inches, a width of approximately 40 inches, and a depth of approximately 14 inches. Shutters of about 5 inches in width were used to cover the shutter opening formed in the front panel of the housing. This arrangement, which was constructed for test purposes, had an aspect ratio of approximately 3 to 2, assuming that with the shutters fully opened, 80% of the front wall of the enclosure was open, the remainder of the front wall being closed by edge framing. This test demonstrated that the swell box operated effectively without detuning of the pipes between the open and closed positions of the shutters, while providing excellent swell characteristics having the qualities previously expected only with very large room size swell chambers.

Although for the sake of maintaining relative portability of the swell box and to permit it to be installed in virtually any location without the need for special construction or special rooms, it is desirable to limit the size of the pipes placed within the swell box, there is no reason why very large pipes could not be incorporated in a shallow, nonreflective swell box of the type disclosed herein, although the larger pipes would create problems of air supply. With smaller size pipes, it is apparent that smaller sources of air can be used, with consequent savings in the size and cost of the air blower. Further, since smaller air blowers do not create significant noise, the smaller units can be placed near or in the swell box, thus solving many of the installation problems of prior pipe organs.

The present swell box is of particular value in keyboard organs, where the low bass notes are electronically produced, thus eliminating the need for the largest organ pipes. This allows the more moderately-sized pipes or all of the pipes, if desired, to be incorporated in one or more swell boxes. Such an arrangement greatly reduces the size of the organ installation while retaining the high quality of sound expected from a full-size pipe organ and swell chamber. This effect can be further enhanced by placing the loudspeakers for the electronically produced sounds within the confines of one or more swell boxes so that operation of the shutters affects the loudspeaker output.

Thus, there has been disclosed a new and unique method for producing a compact but full scale pipe organ which eliminates the unnecessary costs involved in installing large, room size swell chambers, without losing the unique quality and effect of such swell chambers in the production of organ music. In accordance with this invention, the swell chamber can be reduced radically in size and complexity, and can be in the form of a relatively shallow, housing carrying movable shutters and being lined with a sound absorbent material which eliminates the detuning effect of standing waves, thereby permitting a small sized unit to produce the complex and desirable sound of a swell chamber in a portable, reasonably priced unit. Although the present invention is described in terms of preferred embodiments, it will be understood that the foregoing description is merely illustrative of the invention, and that a variety of modifications may be made without departing from the inventive concept. Thus, for example, the housing need not be rectangular, but can be shaped to fit available spaces, and may even have corner walls or a semicircular back wall, for example. Further, the shutters may be located not only on a front wall, but on a part of a side wall, if needed. Thus, the present invention is limited as to scope only by the following claims.

What is claimed is:

1. A compact, portable pipe organ swell box for receiving organ pipes and for providing characteristic pipe organ sounds, comprising:

a shallow housing having closed top, bottom, side and rear walls and an open front, said walls defining an interior space which has sufficient height, width and depth to accommodate a set of organ pipes;

a plurality of shutters mounted for pivotal motion in said box and adapted to rotate between a closed position, which substantially closes the front of said housing, and an open position, which substantially opens the front of said housing;

an air chest mounted within said housing between said rear wall and said shutters;

means for supplying air under pressure to said air chest;

at least one rank of organ pipes mounted on said air chest and communicating therewith to receive pressurized air, each pipe having an opening from which said air flows to produce sound, the opening of each said pipe being so oriented as to direct the sound produced thereby primarily in the direction of said shutters;

means for moving said shutters between their open and closed positions to produce swell effects in the sounds produced by said pipes; and sound absorbing means within said housing and located to prevent the formation of standing waves within the housing, whereby the tuning of said pipes is not adversely affected by variations in standing wave effects caused by the opening and closing of said shutters.

2. The swell box of claim 1, wherein said shutters are comprised of glass panels mounted within the open front of said housing, said panels, when in the closed position, being in edge-to-edge adjacent relationship, but spaced to permit free movement and to allow the escape of some sound from within said swell box.

3. The swell box of claim 1, wherein said box includes two ranks of pipes aligned across the width thereof in staggered relationship, whereby the sound from each pipe has substantially unimpeded access to the front of said housing.

4. The swell box of claim 1, wherein said sound absorbing means comprises a sound absorbent surface on said rear wall, whereby a substantial proportion of the sound radiated by said pipes toward said rear wall is absorbed.

5. The swell box of claim 4, wherein said sound absorbent surface comprises a layer of sound absorbent material mounted on said rear wall.

6. The swell box of claim 4, wherein said sound absorbent surface comprises a multiplicity of angled surfaces on said rear wall, said angled surfaces serving to deflect sound waves in a substantially random manner to prevent the establishment of standing wave patterns in said swell box.

7. The swell box of claim 4, further including a sound absorbent surface on said side and top walls.

8. The swell box of claim 4, wherein said shutters are comprised of glass panels mounted within the open front of said housing, said panels, when closed, being in edge-to-edge adjacent relationship, but spaced to permit free movement and to allow the escape of some sound from within said swell box and, when open, being substantially perpendicular to the open front of said housing to provide a maximum opening for the swell box, whereby the opening and closing of said shutters under the control of an organist during playing of said organ pipes produces a substantial swell effect without detuning said pipes.

* * * * *